US009869467B2

(12) United States Patent
Stark et al.

(10) Patent No.: US 9,869,467 B2
(45) Date of Patent: Jan. 16, 2018

(54) ONCE-THROUGH STEAM GENERATOR

(71) Applicant: Vogt Power International Inc., Louisville, KY (US)

(72) Inventors: Daniel Stark, Louisville, KY (US); Darryl Taylor, Louisville, KY (US); Anthony A. Thompson, Louisville, KY (US); Akber Pasha, Louisville, KY (US); Kelly M. Flannery, Louisville, KY (US)

(73) Assignee: Vogt Power International Inc., Louisville, KY (US)

( * ) Notice: Subject to any disclaimer, the term of this patent is extended or adjusted under 35 U.S.C. 154(b) by 0 days.

(21) Appl. No.: 15/070,762

(22) Filed: Mar. 15, 2016

(65) Prior Publication Data

US 2016/0195261 A1 Jul. 7, 2016

Related U.S. Application Data

(63) Continuation of application No. 13/954,761, filed on Jul. 30, 2013.

(Continued)

(51) Int. Cl.
*F22B 29/06* (2006.01)
*F22B 37/26* (2006.01)

(Continued)

(52) U.S. Cl.
CPC ..... *F22B 29/06* (2013.01); *F22B 37/26* (2013.01); *F22B 37/32* (2013.01); *F22D 1/12* (2013.01); *F22G 1/02* (2013.01); *Y10T 137/0329* (2015.04)

(58) Field of Classification Search
CPC ..... F22B 29/06; F22D 1/12; F22G 1/02

(Continued)

(56) References Cited

U.S. PATENT DOCUMENTS 4,194,468 A * 3/1980 Augsburger ..... F22B 35/14 122/406.5
5,946,901 A * 9/1999 Bauver ..... F22B 1/1815 122/7 R (Continued)

FOREIGN PATENT DOCUMENTS

DE 10 2011 006390 A1 10/2012
WO 99/01697 A1 1/1999
WO 2007-133071 A2 11/2007

OTHER PUBLICATIONS

European Patent Office, Examination Report issued in corresponding Application No. EP 13853758.4, dated Aug. 1, 2016.

(Continued)

*Primary Examiner* — Alissa Tompkins
*Assistant Examiner* — John Bargero
(74) *Attorney, Agent, or Firm* — Stites & Harbison, PLLC; David W. Nagle, Jr.; James R. Hayne

(57) ABSTRACT

A once-through steam generator comprises a duct having an inlet end in communication with a source of a hot gas; and a tube bundle installed in the duct and comprising multiple heat transfer tubes. The tube bundle has an economizer section, an evaporator section, and a superheater section. A steam separating device may be positioned between the evaporator section and the superheater section, wherein, as part of a wet start-up, hot water collected by the steam separating device is delivered from the steam separating device to mix with cold feedwater before it is introduced into the economizer section. A start-up module may be positioned in the duct near the inlet end, wherein, as part of a dry start-up, cold feedwater is delivered into the start-up module to generate hot water that is then mixed into the feedwater stream before it is introduced into the economizer section.

5 Claims, 3 Drawing Sheets

Related U.S. Application Data

(60) Provisional application No. 61/724,051, filed on Nov. 8, 2012.

(51) Int. Cl.
*F22B 37/32* (2006.01)
*F22D 1/12* (2006.01)
*F22G 1/02* (2006.01)

(58) Field of Classification Search
USPC ..... 122/1 B, 448.4
See application file for complete search history.

(56) References Cited

U.S. PATENT DOCUMENTS

| | | | |
|---|---|---|---|
| 6,173,679 | B1 | 1/2001 | Bruckner et al. |
| 9,194,577 | B2 | 11/2015 | Brodeber et al. |

OTHER PUBLICATIONS

European Patent Office, Supplementary Partial European Search Report issued in corresponding Application No. EP 13853758.4, dated May 31, 2016.

* cited by examiner

ONCE-THROUGH STEAM GENERATOR

CROSS-REFERENCE TO RELATED APPLICATIONS

The present application is a continuation of U.S. patent application Ser. No. 13/954,761 filed on Jul. 30, 2013, which claims priority to U.S. Provisional Patent Application Ser. No. 61/724,051 filed on Nov. 8, 2012, the entire disclosures of which is incorporated herein by reference.

BACKGROUND OF THE INVENTION

The present invention relates to once-through steam generators.

A once-through steam generator (OTSG) is a heat recovery boiler that generates steam, primarily for use in power generation or for another industrial process. Traditional fossil fuel boilers, including heat recovery steam generators (HRSG), are commonly characterized as having three separate sections of heat transfer tubes, with a hot flue gas passing around such heat transfer tubes to generate steam. First, economizer sections heat condensate water, often close to the boiling point, but the water typically remains in a liquid phase. Second, evaporator sections convert the water heated in the economizer sections into saturated steam. Third, superheater sections then superheat the steam so that it can be used to power a steam turbine generator or used in another industrial process. In these traditional fossil fuel boilers, the evaporator sections use a forced or natural circulation design such that water passes multiple times through the flue gas by means of a steam drum, which also contains equipment used to effectively separate the steam generated from the circulated water flow.

Referring now to FIG. 1, an exemplary OTSG 10 is different from such a drum-type HRSG in that an OTSG has a single tube bundle 20 that spans the height of the OTSG 10, and a steam drum is not required. The heat transfer tubes of the tube bundle 20 are in a horizontal orientation, and the flue gas passes through the OTSG 10 on an upward (vertical) path, with cold feedwater entering at the top of the tube bundle 20 and superheated steam exiting at the bottom of the tube bundle 20. In this manner, the OTSG 10 is well-suited to recover waste heat from a combustion turbine 30, as shown in FIG. 1.

There are several advantages with respect to the use of an OTSG as compared to a drum-type HRSG. Without a steam drum, there are fewer controls, and less instrumentation is required, which allows for simplified operation. Also, because the steam drum walls in an HRSG are prone to fatigue failures that result from rapid temperature change, an OTSG unit can usually start up faster. In other words, without a steam drum, there is not the same need to limit large temperature differentials as compared to typical drum-type HRSG.

At the same time, however, there are disadvantages with respect to the use of an OTSG. For example, during a shutdown, there are no provisions to allow water to remain inside of the tube bundle. Therefore, costly boiler feedwater must be drained from the tube bundle at every shutdown. Subsequent start-ups then require cold feedwater to be introduced into a hot OTSG in order to immediately begin generating steam. This introduction of cold feedwater into hot heat transfer tubes causes large thermal fatigue stresses, dramatically reducing cycle life of the heat transfer tubes in the upper inlet areas. Another problem of traditional OTSG designs is that during rapid transient load changes of the combustion turbine, including a trip or a shutdown, there is potential for large slugs of water to enter the lower superheating section of the OTSG. This can also cause large thermal stresses, which further reduces cycle life in these critical areas.

SUMMARY OF THE INVENTION

The present invention is a once-through steam generator (OTSG) that includes auxiliary components that facilitate a wet start-up and/or a dry start-up without suffering from the above-described disadvantages of prior art constructions.

An exemplary OTSG made in accordance with the present invention includes a duct having an inlet end and a discharge end. The duct is connected to a source of a hot gas, such as a combustion turbine, such that the hot gas flows from the inlet end to the discharge end. A tube bundle is positioned in the duct and essentially spans the height of the duct, with the heat transfer tubes of the tube bundle in a horizontal orientation. Although each heat transfer tube of the tube bundle defines a single continuous path through the duct, the tube bundle can nonetheless be characterized as having: an economizer section, which is nearest the discharge end of the duct; an evaporator section; and a superheater section, which is nearest the inlet end of the duct. Feedwater is introduced into the tube bundle via feedwater delivery piping and then flows through the tube bundle in a direction opposite to that of the flue gas, passing through: the economizer section, where the temperature of the feedwater is elevated, often close to the boiling point; the evaporator section, where the water is converted into saturated steam; and the superheater section, where the saturated steam is converted to superheated steam that can be used to power a steam turbine generator or used in another industrial process.

The OTSG may also include a steam separating device, such as a loop seal separator, that is positioned in-line with the heat transfer tubes of the tube bundle between the evaporator section and the superheater section. Through use of this loop seal separator, the combustion turbine may be started with water remaining in the heat transfer tubes of the tube bundle. During start-up, hot water and saturated steam thus exit the evaporator section via piping and are delivered to the loop seal separator. Hot water collected in the loop seal separator is then delivered to the feedwater delivery piping, while steam collected in the loop seal separator is returned to the superheater section. Furthermore, during normal design operation, the positioning of the loop seal separator between the evaporator section and the superheater section means only dry steam (with a small degree of superheat) will enter the loop seal separator. In any event, during a hot wet start-up, hot water collected in the loop seal separator is delivered to and mixed with cold feedwater entering the OTSG, thus preventing or at least minimizing thermal shock that would otherwise result from cold feedwater entering hot heat transfer tubes of the tube bundle in the OTSG.

The OTSG may also include a start-up module, which is a set of heat transfer tubes positioned in the duct near the inlet end for use in a dry start-up, when the OTSG is hot, but there is no water in the heat transfer tubes of the tube bundle. Specifically, rather than using the traditional scheme of sending cold feedwater into the hot heat transfer tubes of the tube bundle, cold feedwater is first delivered into the start-up module. Because of the positioning of the start-up module in the duct near the inlet end, superheated steam is initially generated in the start-up module, and that superheated steam then exits the start-up module and is delivered back to the feedwater delivery piping where it enters the OTSG to begin a controlled cool-down in the upper inlet areas of the OTSG. As the rate of cold feedwater to the start-up module is increased, the outlet degree of superheat temperature of the steam from the start-up module decreases, until there is a phase change, and hot water is exiting the start-up module and delivered back to the feedwater delivery piping. This hot water exiting the start-up module is then mixed into a cold feedwater stream into the OTSG. Thus, the rate change of the temperature of the feedwater entering the OTSG is controlled, which minimizes the problem of thermal fatigue stresses in the upper inlet areas of the OTSG.

DETAILED DESCRIPTION OF THE INVENTION

The present invention is a once-through steam generator (OTSG) that includes auxiliary components that facilitate a wet start-up and/or a dry start-up without suffering from the above-described disadvantages of prior art constructions.

Figure 1:
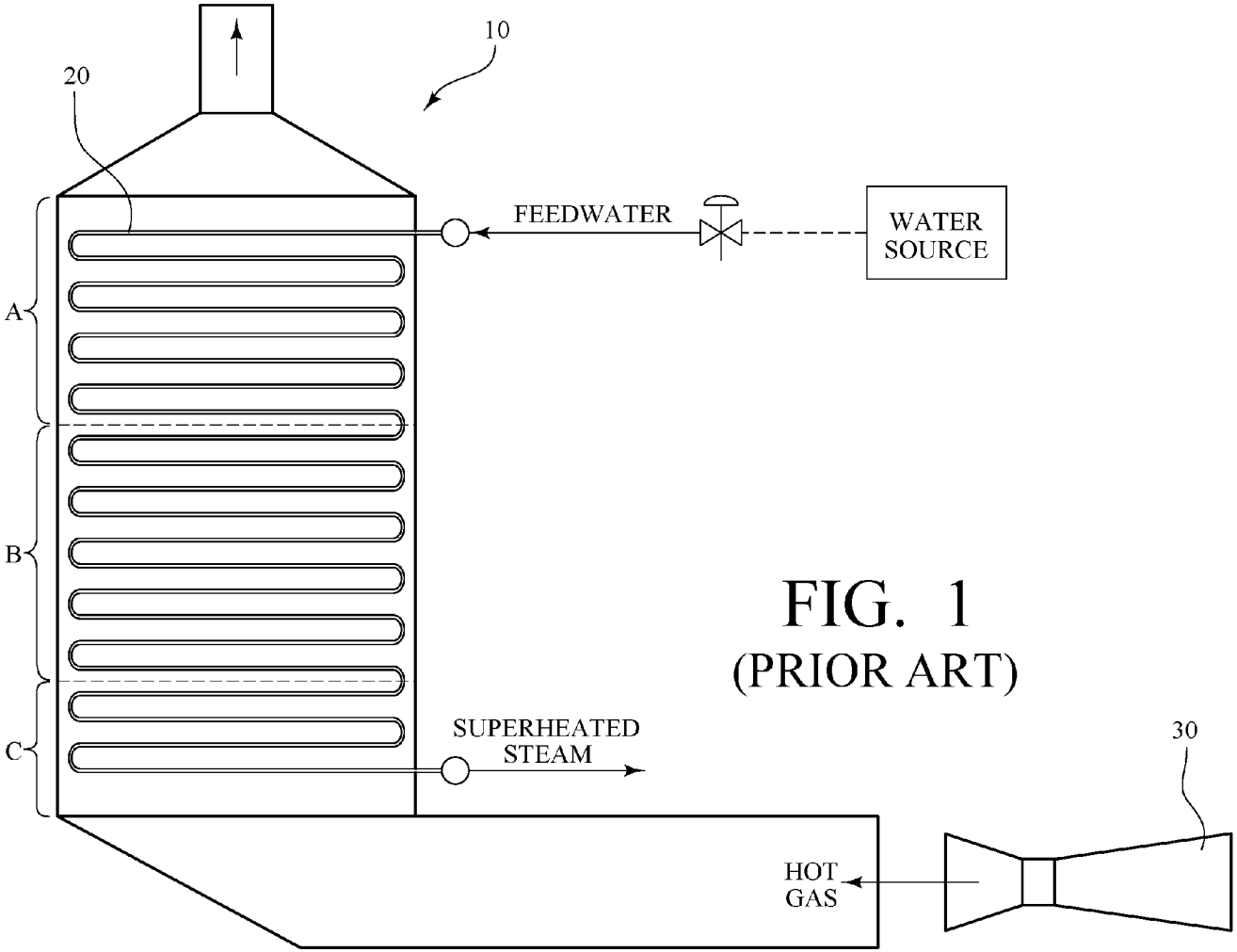
FIG. 1 (PRIOR ART)
FIG. 1 is a schematic view of a prior art once-through steam generator.
Figure 2:
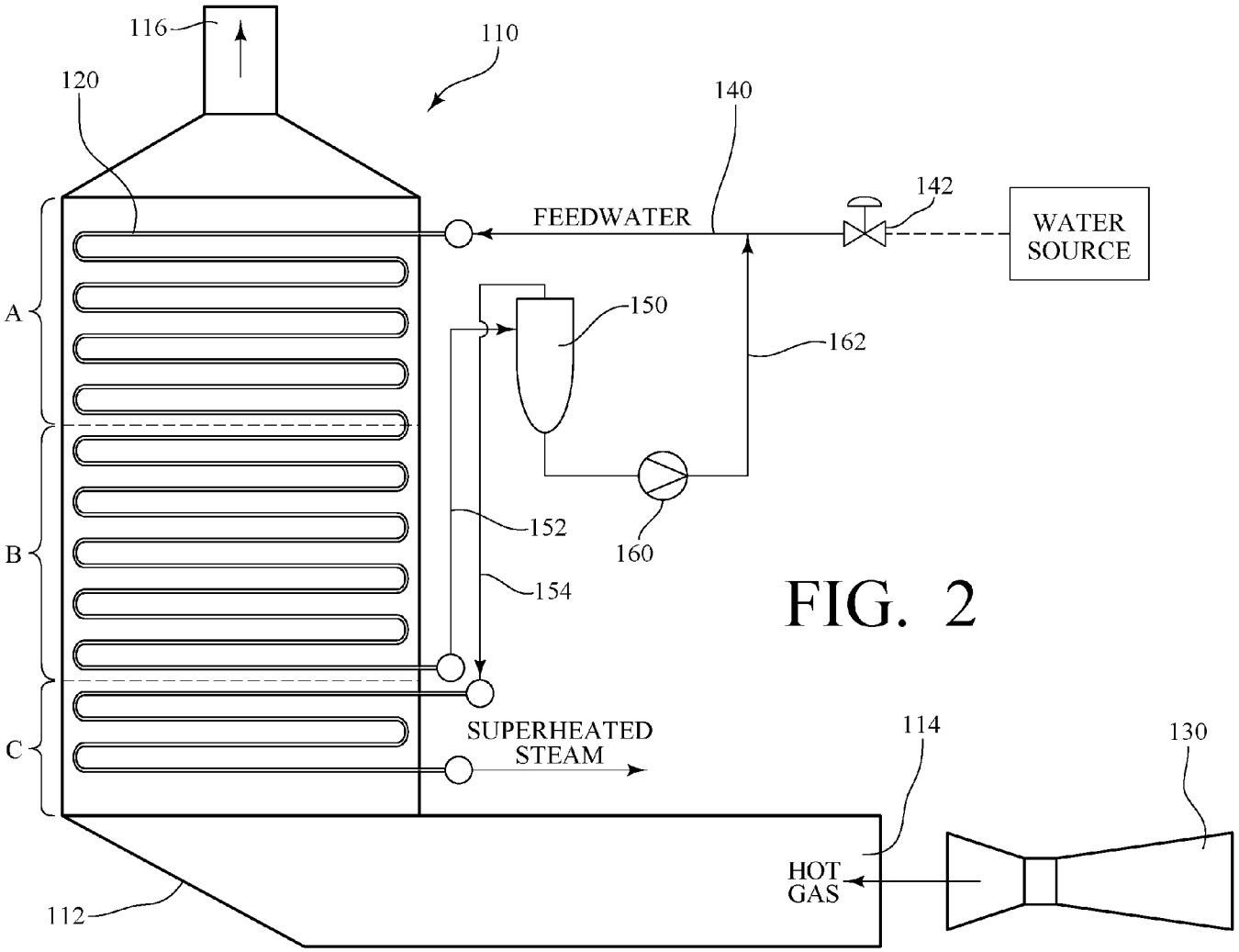
FIG. 2 is a schematic view of an exemplary once-through steam generator made in accordance with the present invention.

Referring now to FIG. 2, an exemplary OTSG 110 made in accordance with the present invention includes a duct 112 having an net end 114 and a discharge end 116. The duct 112 is connected to a source 130 of a hot gas (in this case, hot flue gas from a combustion turbine), such that the hot gas flows from the inlet end 114 to the discharge end 116. A tube bundle 120 is positioned in the duct 112 and essentially spans the height of the duct 112, with the heat transfer tubes of the tube bundle 120 in a horizontal orientation. Although each heat transfer tube of the tube bundle 120 defines a single continuous path through the duct 112, the tube bundle 120 can nonetheless be characterized as having: an economizer section (A), which is nearest the discharge end 116 of the duct 112; an evaporator section (B); and a superheater section (C), which is nearest the inlet end 114 of the duct 112. Feedwater is introduced into the tube bundle 120 via feedwater delivery piping 140, for example, through the opening of a feedwater control valve 142. Feedwater then flows through the tube bundle 120 in a direction opposite to that of the flue gas, passing through: the economizer section (A), where the temperature of the feedwater is elevated, often close to the boiling point, but the water typically remains in a liquid phase; the evaporator section (B), where the water is converted into saturated steam; and the superheater section (C), where the saturated steam is converted to superheated steam that can be used to power a steam turbine generator or used in another industrial process.

Referring still to FIG. 2, the OTSG 110 further includes a loop seal separator 150 that is positioned in-line with the heat transfer tubes of the tube bundle 120 between the evaporator section (B) and the superheater section (C). Through use of this loop seal separator 150, the combustion turbine 130 may be started with water remaining in the heat transfer tubes of the tube bundle 120. Specifically, the loop seal separator 150 is a centrifugal steam separating device that, as stated above, is positioned between the evaporator section (B) and the superheater section (C), essentially separating the evaporator section (B) from the superheater section (C). During start-up, hot water and saturated steam thus exit the evaporator section (B) via piping 152 and are delivered to the loop seal separator 150. Hot water collected in the loop seal separator 150 is then delivered via piping 162 to the feedwater delivery piping 140 using a circulation pump 160, while steam collected in the loop seal separator 150 is returned to the superheater section (C) via piping 154. Furthermore, during normal design operation, the positioning of the loop seal separator 150 between the evaporator section (B) and the superheater section (C) means only dry steam (with a small degree of superheat) will enter the loop seal separator 150. In any event, during a hot wet start-up, hot water collected in the loop seal separator 150 is delivered to and mixed with cold feedwater entering the OTSG 110 via feedwater delivery piping 140, thus preventing or at least minimizing thermal shock that would otherwise result from cold feedwater entering hot heat transfer tubes of the tube bundle 120 in the OTSG 110. The circulation pump 160 continues to operate until the OTSG load increases, and water no longer enters the loop seal separator 150. Another benefit of the loop seal separator 150 is that, during rapid load changes, such as combustion turbine trips or shutdown, the loop seal separator 150 prevents slugs of water from thermally stressing hot superheating sections of the heat transfer tubes of the tube bundle 120. So, through the use of the loop seal separator 150, costly boiler feedwater does not need to be drained from the tube bundle 120 at every shutdown.

Figure 3:
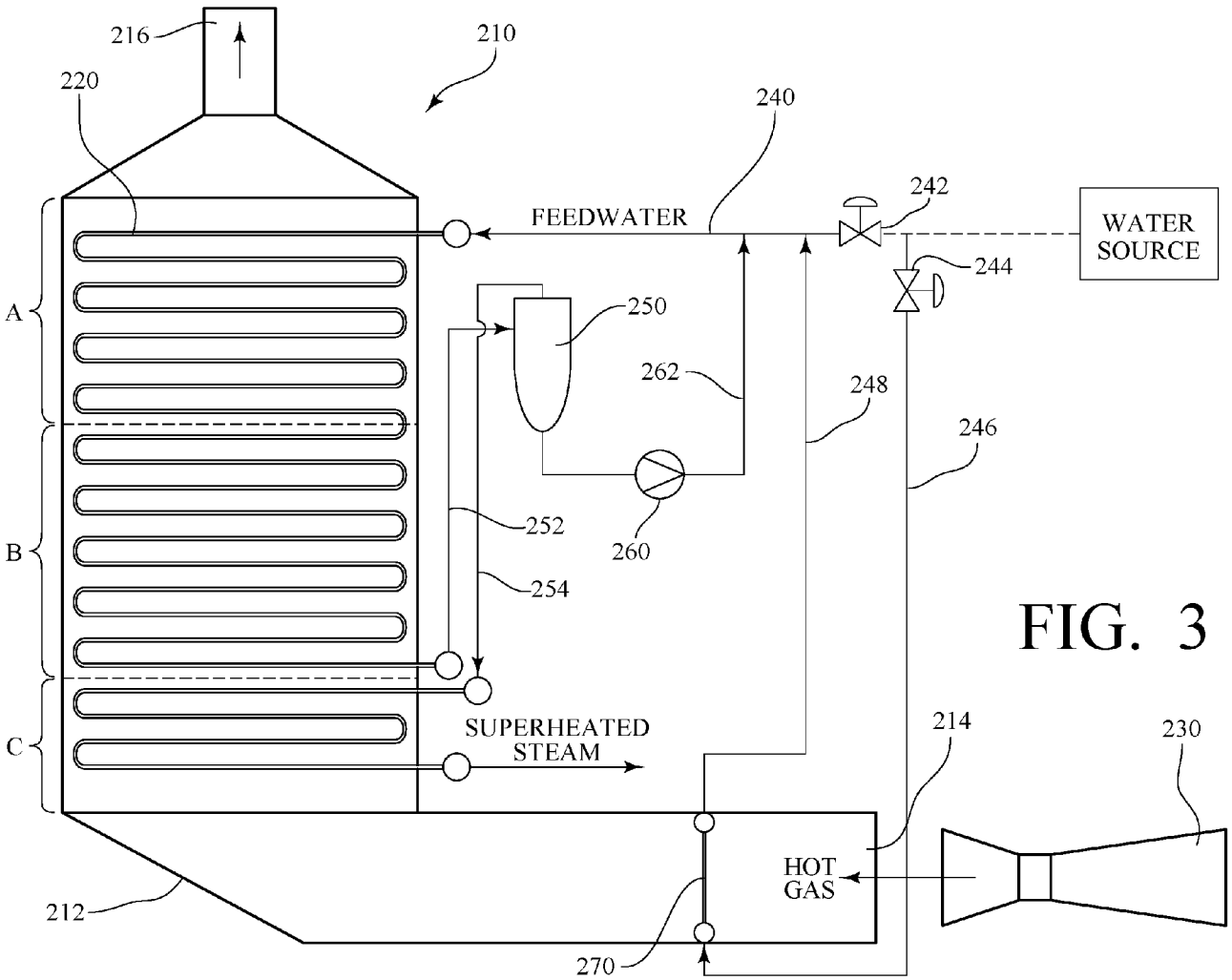
FIG. 3 is a schematic view of another exemplary once-through steam generator made in accordance with the present invention.

Referring now to FIG. 3, another exemplary OTSG 210 made in accordance with the present invention also includes a duct 212 having an inlet end 214 and a discharge end 216. The duct 212 is connected to a source 230 of a hot gas (in this case, hot flue gas from a combustion turbine), such that the hot gas flows from the inlet end 214 to the discharge end 216. A tube bundle 220 is positioned in the duct 212 and essentially spans the height of the duct 212, with the heat transfer tubes of the tube bundle 220 in a horizontal orientation. Although each heat transfer tube of the tube bundle 220 defines a single continuous path through the duct 212 the tube bundle 220 can again be characterized as having: an economizer section (A); an evaporator section (B); and a superheater section (C). Feedwater is introduced into the tube bundle 220 via feedwater delivery piping 240, for example, through the opening of a feedwater control valve 242. Feedwater then flows through the tube bundle 220 in a direction opposite to that of the flue gas, passing through: the economizer section (A), where the temperature of the feedwater is elevated, often close to the boiling point, but the water typically remains in a liquid phase; the evaporator section (B), where the water is converted into saturated steam; and the superheater section (C), where the saturated steam is converted to superheated steam that can be used to power a steam turbine generator or used in another industrial process.

Similar to the embodiment illustrated in FIG. 2 and described above, the OTSG 210 further includes a loop seal separator 250 that is installed between the evaporator section (B) and the superheater section (C) of heat transfer tubes and an associated circulation pump 260. As with the embodiment illustrated in FIG. 2 and described above, hot water and saturated steam thus exit the evaporator section (B) via piping 252 and are delivered to the loop seal separator 250. Hot water collected in the loop seal separator 250 can then be delivered via piping 262 to the feedwater delivery piping 240 using a circulation pump 260, while steam collected in the loop seal separator 250 can be returned to the superheater section (C) via piping 254.

Unlike the embodiment illustrated in FIG. 2 and described above, the OTSG 210 also includes a start-up module 270, which is another set of heat transfer tubes, positioned in the duct 212 near the inlet end 214 for use in a dry start-up, when the OTSG 210 is hot, but there is no water in the heat transfer tubes of the tube bundle 220. Specifically, rather than using the traditional scheme of sending cold feedwater into the hot heat transfer tubes of the tube bundle 220, cold feedwater is first delivered into the start-up module 270 via piping 246. In this embodiment, the cold feedwater is first delivered via piping 246 by opening another feedwater control valve 244, while the feedwater control valve 242 is closed. Because of the positioning of the start-up module 270 in the duct 212 near the inlet end 214, cold feedwater entering the start-up module 270 initially flashes to superheated steam, and that superheated steam then exits the start-up module 270 and is delivered back to the feedwater delivery piping 240 via piping 248 where it enters the OTSG 210 to begin a controlled cool-down in the upper inlet areas of the OTSG 210. As the rate of cold feedwater to the start-up module 270 is increased (through use of the control valve 244), the outlet degree of superheat temperature of the superheated steam from the start-up module 270 decreases because of less exposure time to the flue gas, thus continuing the controlled cool-down in the upper inlet areas of the OTSG 210. As the rate of cold feedwater to the start-up module 270 continues to increase, the outlet degree of superheat temperature reaches zero, such that dry saturated steam is exiting the start-up module 270. The rate of cold feedwater to the start-up module 270 can then be even further increased, so that hot water (instead of steam) is exiting the start-up module 270. Thus, a phase change from steam to water occurs in the flow exiting the start-up module 270 and delivered back to the feedwater delivery piping 240 via piping 248. At that time, the feedwater control valve 242 is open, so that the hot water exiting the start-up module 270 and delivered back to the feedwater delivery piping 240 begins mixing with a cold feedwater stream passing through the feedwater control valve 242. At this point, the rate of cold feedwater to the start-up module 270 can be held constant, with the hot water from the start-up module 270 mixing with the cold feedwater stream before entering the tube bundle 220 of the OTSG 210, thus continuing to cool down the tube bundle 220 of the OTSG 210 and preventing or at least minimizing the thermal fatigue stress in the upper inlet areas of the OTSG 210.

Although the start-up module 270 may be exposed to the same thermal fatigue stresses as the tubes in the upper inlet areas of a traditional OTSG, by arranging the tubes of the start-up module 270 in a vertical orientation, cycle life should be improved. Furthermore, the positioning of the start-up module 270 in the duct near the inlet end 214 allows for a relatively uncomplicated and lower-cost replacement if failures develop.

Thus, through use of the loop seal separator 250 and the start-up module 270, both a wet start-up and a dry start-up are possible without damaging or reducing the useful life of the OTSG 210.

One of ordinary skill in the art will also recognize that additional embodiments and implementations are also possible without departing from the teachings of the present invention. This detailed description, and particularly the specific details of the exemplary embodiments and implementations disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A once-through steam generator, comprising:

a duct having an inlet end in communication with a source of a hot gas;

a tube bundle installed in the duct and comprising multiple heat transfer tubes that each define a single path from a top end to a bottom end, the tube bundle being characterized as having an economizer section, an evaporator section, and a superheater section, with a feedwater stream being received at the top end in the economizer section and superheated steam being discharged at the bottom end from the superheater section; and a start-up module comprised of a set of heat transfer tubes positioned in the duct near the inlet end and in fluid communication with the feedwater delivery piping, wherein, as part of a dry start-up, a first stream of cold feedwater is delivered into the start-up module to initially generate superheated steam which is delivered to and enters into the economizer section as an inlet stream to begin a controlled cool-down, with the inlet stream transitioning from such superheated steam to hot water as a rate of the first stream of cold feedwater delivered to the start-up module is increased, with such hot water of the inlet stream then being mixed into a second stream of cold feedwater before it enters into the economizer section, thus continuing the controlled cool-down and minimizing thermal fatigue stresses near the top end of the once-through steam generator.

2. The once-through steam generator as recited in claim 1, and further comprising a steam separating device positioned between the evaporator section and the superheater section.

3. The once-through steam generator as recited in claim 2, in which the steam separating device is a loop seal separator.

4. The once-through steam generator as recited in claim 3, in which the loop seal separator is positioned in-line with the heat transfer tubes of the tube bundle between the evaporator section and the superheater section.

5. A method for minimizing thermal fatigue stresses in a once-through steam generator that includes a duct having an inlet end in communication with a source of a hot gas and a tube bundle installed in the duct and comprising multiple heat transfer tubes that each define a path from a top end to a bottom end, comprising the steps of:

positioning a start-up module comprised of a set of heat transfer tubes in the duct near the inlet end and in fluid communication with feedwater delivery piping for delivering feedwater to an economizer section of the tube bundle at a the top end of the duct;

delivering a first stream of cold feedwater into the start-up module to initially generate superheated steam, which is delivered back to the feedwater delivery piping as an inlet stream where it provides a controlled cool-down to minimize thermal fatigue stresses near the top end of the once-through steam generator; and increasing a rate of the first stream of cold feedwater to the start-up module rate until a phase change of the inlet stream from steam to water occurs, such that the inlet stream is hot water which is then delivered back to the feedwater delivery piping where the inlet stream begins mixing with a second stream of cold feedwater before it is introduced into the economizer section.

* * * * *